US008618747B2

(12) United States Patent
Park et al.

(10) Patent No.: US 8,618,747 B2
(45) Date of Patent: Dec. 31, 2013

(54) POWER FACTOR CORRECTION CIRCUIT AND DRIVING METHOD THEREOF

(75) Inventors: Young-Bae Park, Anyang (KR); Sang Cheol Moon, Bucheon (KR); Byoung Heon Kim, Hwaseong (KR); Hyung Min Kim, Bucheon (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 337 days.

(21) Appl. No.: 13/044,307

(22) Filed: Mar. 9, 2011

(65) Prior Publication Data

US 2011/0221402 A1 Sep. 15, 2011

(30) Foreign Application Priority Data

Mar. 12, 2010 (KR) ..... 10-2010-0022486

(51) Int. Cl.
*H05B 37/02* (2006.01)

(52) U.S. Cl.
USPC ..... 315/307; 315/209; 323/222; 323/207

(58) Field of Classification Search
USPC ..... 323/207, 222, 211, 224, 237, 282–288, 323/299; 315/106, 209 R, 219, 220, 225, 315/224, 243, 291, 507; 363/17, 20, 21.12, 363/21.17, 37, 40–41, 81, 89, 91, 97, 98, 363/56.01, 56.11
See application file for complete search history.

(56) References Cited

U.S. PATENT DOCUMENTS

| | | | | |
|---|---|---|---|---|
| 5,479,336 | A * | 12/1995 | Motoki et al. | 363/89 |
| 6,049,471 | A * | 4/2000 | Korcharz et al. | 363/20 |
| 6,617,805 | B2 | 9/2003 | Ribarich et al. | |
| 6,864,144 | B2 * | 3/2005 | Kenyon et al. | 438/302 |
| 6,864,644 | B2 * | 3/2005 | Kernahan | 315/307 |
| 6,946,819 | B2 * | 9/2005 | Fagnani et al. | 323/207 |
| 7,133,300 | B1 * | 11/2006 | Yang | 363/56.11 |
| 8,242,755 | B2 * | 8/2012 | Park et al. | 323/222 |

* cited by examiner

*Primary Examiner* — Rajnikant Patel
(74) *Attorney, Agent, or Firm* — Okamoto & Benedicto LLP

(57) ABSTRACT

The present invention relates to a power factor correction circuit and a driving method thereof. The power factor correction circuit refers to an inductor receiving an input voltage and supplying output power, a power switch connected to the inductor and controlling an inductor current flowing in the inductor, and an auxiliary coil coupled with the inductor with a predetermined turn ratio. The power factor correction circuit controls the output power by controlling a switching operation of the power switch, and counts the number of times that the inductor current reaches a predetermined maximum current to turn off the power switch when the count result reaches a predetermined short circuit threshold count.

15 Claims, 9 Drawing Sheets

POWER FACTOR CORRECTION CIRCUIT AND DRIVING METHOD THEREOF

CROSS-REFERENCE TO RELATED APPLICATION

This application claims priority to and the benefit of Korean Patent Application No. 10-2010-0022486 filed in the Korean Intellectual Property Office on Mar. 12, 2010, the entire contents of which are incorporated herein by reference.

BACKGROUND OF THE INVENTION (a) Field of the Invention

The present invention relates to a power factor correction circuit and a driving method thereof.

(b) Description of the Related Art

A power factor correction circuit controls a switching operation of a power switch in order to generate an average input current that equals a full-wave rectified voltage (hereinafter referred to as an input voltage) in shape. A bridge diode of the power factor correction circuit generates an input voltage by rectifying AC input power, and in this case, the input voltage is a full-wave rectified sine wave.

FIG. 1 shows an input voltage, an inductor current, and an average input current of a conventional power factor correction circuit.

As shown in FIG. 1, an inductor current of the power factor correction circuit is iteratively increased and decreased according to a switching operation of the power switch, and a peak value of the inductor current depends on a full-wave rectified sine wave. Then, the average input current and the full-wave rectified voltage are the same in waveform.

The power factor correction circuit sets the maximum current to control the switching operation of a switch within a range that the inductor current does not exceed the maximum current. The reason that the power converter sets the maximum current for protection and the reason that the power factor correction circuit sets the maximum current are different from each other. Since a switch current of the power factor correction circuit depends on an arbitrary input voltage, the peak value of the switch current is decreased when the input voltage starts to decrease after the peak value of the switch current reaches the maximum current. Therefore, it is difficult to control a protection of the power factor correction circuit to use the maximum current. Furthermore, when the input voltage is low and in the overload state, users prefer that the switch current reaches the maximum current in a ridge period of an input voltage waveform.

The power factor correction circuit senses a time point when the inductor current becomes zero using an auxiliary coil coupled to the inductor. The power factor correction circuit turns on the switch when the inductor current is zero. When a zero current sense signal telling the inductor current to become zero is not generated for a predetermined time, the power factor correction circuit turns on the switch with a predetermined cycle by force. This operation occurs at the start-up state or when the input voltage is close to zero. However, the auxiliary coil may be short-circuited in the power factor correction circuit. Then, inductance of a magnetically combined inductor of the power factor correction circuit is decreased due to the short circuit of the auxiliary coil. Since the auxiliary coil is short-circuited and no signal is generated therein, sensing a time point when the inductor current becomes zero fails, and a current flowing in the inductor is suddenly increased due to an inductance decrease of the power factor correction circuit.

When the zero current detection signal is not generated, the switch is turned on by force with the predetermined cycle so that the switch current reaches the maximum current within a very short period of time. In this case, the short circuit of the auxiliary coil is continued for a long period of time, temperature of a transformer formed of the inductor and the auxiliary coil is increased, and a coating of the auxiliary coil may be melted due to the increased temperature. Moreover, when the auxiliary coil is continuously short-circuited, heat or explosion due to an overcurrent flowing to the auxiliary coil, the inductor, and the power switch may damage a human body. Therefore, the short circuit of the auxiliary coil needs to be sensed.

However, as previously stated, the auxiliary coil may not be short-circuited even though the inductor current is higher than the maximum current due to the inductor current characteristic of the power factor correction circuit. In the power factor correction circuit, it is difficult to determine whether the overcurrent is caused due to a short circuit of the auxiliary coil.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a power factor correction circuit that can sense a short circuit of an auxiliary coil, and a driving method thereof.

A power factor correction circuit according to an exemplary embodiment of the present invention includes an inductor receiving an input voltage and supplying output power, a power switch connected to the inductor and controlling an inductor current flowing in the inductor, an auxiliary coil coupled with the inductor with a predetermined turn ratio, and a power factor correction controller controlling the output power by controlling a switching operation of the power switch and counting the number of times that the inductor current reaches a predetermined maximum current to turn off the power switch when the count reaches a predetermined short circuit threshold count.

The power factor correction controller counts the number of times that a switch current flowing in the power switch, corresponding to the inductor current, reaches the maximum current and turns off the power switch when the count results in the short circuit threshold count.

The power factor correction controller resets the count result when the inductor current becomes zero.

The power factor correction controller includes an N-bit counter counting the number of times that the switch current reaches the maximum current (here, N is a natural number), a D-flipflop generating a disable signal according to an output of the N-bit counter, and a logic operator synchronized with a time point when the inductor current becomes zero and resetting the N-bit counter and the D-flipflop. The N-bit has a value corresponding to the short circuit threshold count.

The power factor correction controller further includes a comparator that compares a sense voltage corresponding to the switch current with a reference voltage corresponding to the maximum current to generate a maximum current sense signal when the sense voltage reaches the reference voltage. The N-bit counter counts the number of times that the maximum current sense signal is generated and generates a count signal when the count result reaches the short circuit threshold count, and the D-flipflop generates the disable signal when the count signal is input.

The N-bit counter counts the number of times that the maximum current sense signal is generated and generates a count signal when the count result reaches the short circuit threshold count, and the D-flipflop generates the disable signal when the count signal is input. The power factor correction controller includes an N-bit counter counting the number of times that the switch current reaches the maximum current (here, N is a natural number), a D-flip-flop generating a disable signal according to an output of the N-bit counter, and a logical operator resetting the N-bit counter and the D-flipflop according to the zero current detection signal. The N-bit has a value corresponding to the short circuit threshold count.

A driving method of a power factor correction circuit including an inductor receiving an input voltage and supplying output power, a power switch connected to the inductor to control an inductor current flowing in the inductor, and an auxiliary coil coupled with the inductor with a predetermined turn ratio, includes counting the number of times that the inductor current reaches a predetermined maximum current and turning off the power switch when the count result reaches a predetermined short circuit threshold count. The driving method further includes determining whether the inductor current is zero and resetting the count result when the inductor current is zero. The determining whether the inductor current is zero includes receiving a zero current detection voltage corresponding to a voltage of the auxiliary coil and determining that the inductor current is zero when the zero current detection voltage is decreased to a predetermined ON reference voltage.

The counting the number of times that the inductor current reaches a predetermined maximum current comprises counting the number of times that a switch current flowing to the power switch, corresponding to the inductor current, reaches the maximum current.

The counting the number of times that the switch current reaches the maximum current includes comparing a sense voltage corresponding to the switch current with a reference voltage corresponding to the maximum current to generate a maximum current sense signal when the sense voltage reaches the reference voltage and counting the number of generation times of the maximum current sense signal.

The present invention provides a power factor correction circuit that can precisely senses auxiliary coil short-circuit, and a driving method thereof.

DETAILED DESCRIPTION OF THE EMBODIMENTS

Figure 1:
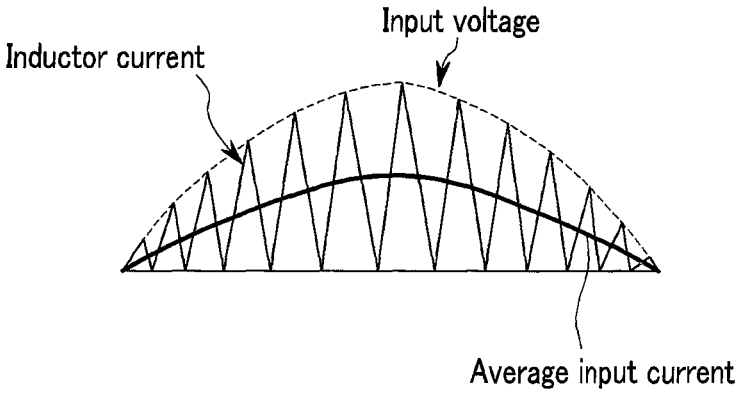
FIG. 1 shows an input voltage, an inductor current, and an average input current of a conventional power factor correction circuit.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 2:
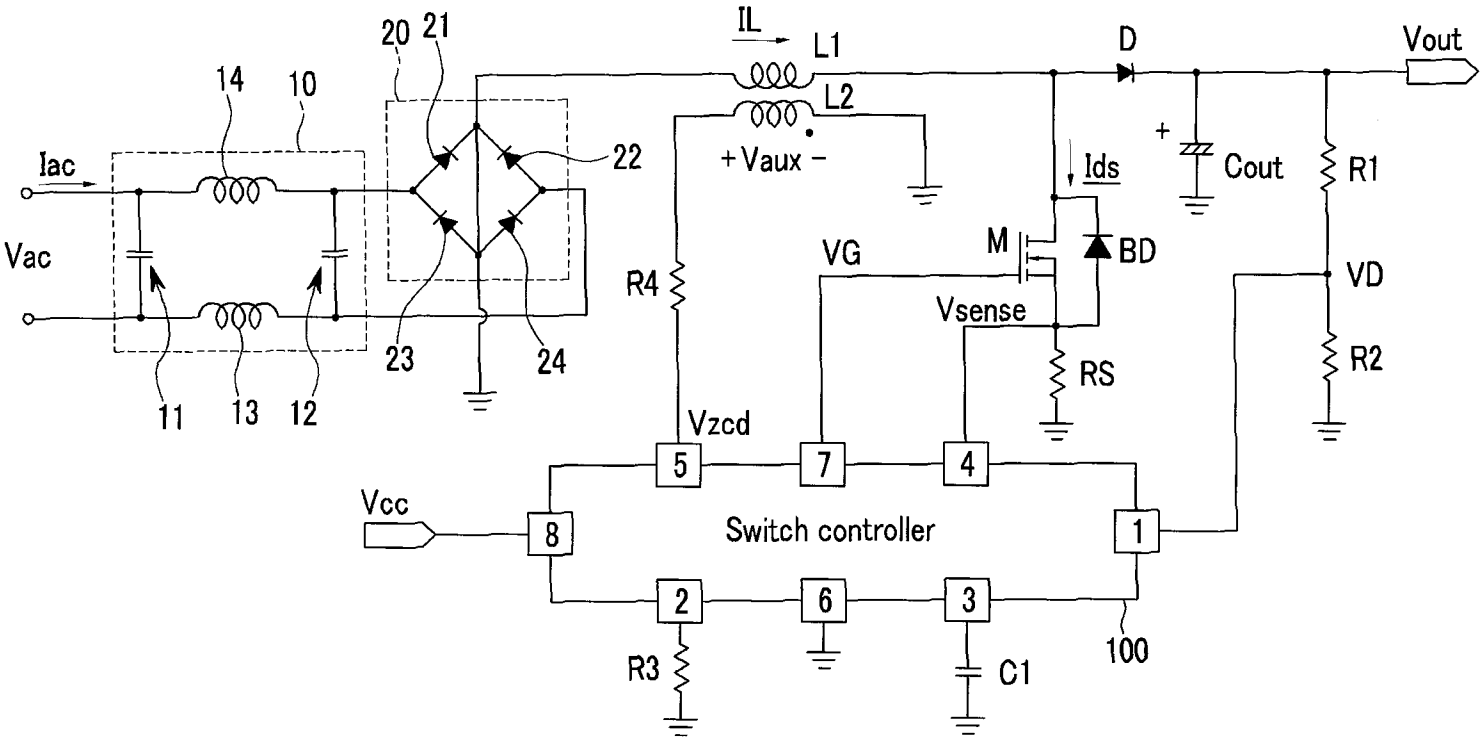
FIG. 2 shows a power factor correction circuit according to an exemplary embodiment of the present invention.

FIG. 2 shows a power factor correction circuit according to an exemplary embodiment of the present invention.

A power factor correction circuit 1 includes a line filter 10, a bridge diode 20, an inductor L1, a power switch M, a capacitor Cout, a sense resistor RS, an auxiliary coil L2, a diode D, output voltage division resistors R1 and R2, and a power factor correction controller 100. Body diodes BD are formed in parallel in the power switch M.

The input filter 10 is formed of capacitors 11 and 12 and inductors 13 and 14, and eliminates a noise component of input AC power. The capacitor 11 and the capacitor 12 are connected in parallel with each other, the inductor 13 is connected between a first end of the capacitor 11 and a first end of the capacitor 12, and the inductor 14 is connected between a second end of the capacitor 11 and a second end of the capacitor 12. The inductor 13 and the inductor 14 are electrically coupled with each other, and the electrically coupled inductors 13 and 14 are referred to as coupled inductors. The input filter 10 in the power factor correction circuit 1 eliminates a noise component of AC power input to the power factor correction circuit 1 and smoothes an inductor current IL into the shape of an average input current as shown in FIG. 1.

The bridge diode 20 is formed of four diodes 21 to 24, and generates an input voltage Vin by wave-rectifying the input AC power.

As a power transmission element, the input voltage Vin is supplied to a first end of the inductor L1 and a second end of the inductor L1 is connected to the power switch M and an anode of the diode D. The inductor L1 receives the input voltage Vin and generates output power. Switching operation of the power switch M controls an inductor current IL flowing in the inductor L1. With a triangle-shaped waveform, the inductor current IL is increased during the time that the power switch M is turned on and decreased during the time that the power switch M is turned off. In further detail, the inductor current IL is increased during time that the power switch M is turned on and the inductor L1 stores energy. During the time that the power switch M is turned off, the inductor current IL flows through the diode D and the energy stored in the inductor L1 is transmitted to an output end of the power factor correction circuit 1. When the power switch M is turned off and the diode D is connected, the inductor current IL flows to the output end of the power factor correction circuit 1 and charges the capacitor Cout.

The auxiliary coil L2 is coupled to the inductor L1 with a predetermined turn ratio. When a winding number of the inductor L1 is N and a winding number of the auxiliary coil L2 is 1, the predetermined turn ratio becomes 1/N. A voltage at lateral ends of the inductor L1 is changed according to the turn ratio and thus it becomes an auxiliary voltage Vaux of the auxiliary coil L2. The auxiliary voltage Vaux is used for controlling a zero current switching operation. The zero current switching will be described later in further detail.

The power switch M is formed of an n-channel metal oxide semiconductor field effect transistor (NMOSFET), and is turned on/off according to a gate control signal Vgs of the power factor correction controller 100. A drain electrode of the power switch M is connected to the anode of the diode D and the second end of the inductor L1, and a source electrode is connected to a first end of the sense resistor RS. A second of the sense resistor RS is grounded. The power factor correction controller 100 determines a turn-off time of the power switch M using a voltage Vsense at the first end of the sense resistor RS. The power switch M is turned on by a high-level gate control signal Vgs, and is turned off by a low-level gate control signal Vgs. Since the power switch M is turned on and a current flows to the sense resistor RS and thus the sense voltage Vsense is generated, a switch current Ids flowing in the power switch M and the sense voltage Vsense have the same waveform.

A cathode of the diode D is connected to a first end of the capacitor Cout. When the power switch M is turned off, the current flowing to the inductor L1 flows to the diode D. The capacitor Cout is charged by an input current Iin and thus an output voltage Vout is generated.

The division voltages R1 and R2 voltage-divides an output voltage Vout to generate a division voltage VD.

The power factor correction controller 100 includes connection terminals 1 to 8 realized by 8 pins. The division voltage VD is input to the connection terminal 1, and the connection terminals 2 and 3 are respectively connected to the resistor R1 and the capacitor C1. The power factor correction controller 100 generates a sawtooth wave using the resistor R3, and the capacitor C1 adjusts a voltage gain that is generated from amplification of a voltage difference between the division voltage VD and a predetermined reference voltage for each frequency component. The sense voltage Vsense is input to the connection terminal 4, the auxiliary voltage Vaux is input to the connection terminal 5 through the resistor R4, and a power source voltage Vcc for operation of the power factor correction controller 100 is input to the connection terminal 8. A signal input to the connection terminal 5 will hereinafter be referred to as a zero current detection voltage Vzcd. The zero current detection voltage Vzcd corresponds to the auxiliary voltage Vaux, and is determined according to the auxiliary voltage Vaux. The gate control signal Vg is output to the connection terminal 7, and the connection terminal 6 is grounded.

The power factor correction controller 100 generates an error amplification signal VCON using the division voltage VD generated from division of the output voltage Vout according to a resistance ratio (R2/(R1+R2)) of the division resistors R1 and R2, and determines a turn-off time of the power switch M1 by comparing the error amplification signal VCON with a ramp signal Vramp having a predetermined cycle.

When the zero current detection voltage Vzcd that corresponds to the auxiliary voltage Vaux reaches a predetermined zero current reference voltage after the turn-off time of the power switch M, the power switch M is turned on. At this point, no current flows to the inductor L1, that is, the inductor current IL is zero. When the power switch M is turned on at the point that no current flows to the inductor L1, the power switch M can be turned on when a voltage at lateral ends of the power switch M is a minimum. Then, a switching loss can be reduced.

The power factor correction controller 100 turns on the power switch M by force when no zero current point of the inductor current IL is detected. In further detail, when the power switch M is not turned on during a predetermined maximum set period, the power switch M is turned on at every maximum set period by force. In this case, a switching frequency of the power switch M according to the maximum set period is a minimum switching frequency.

The power factor correction controller 100 according to the exemplary embodiment of the present invention counts the number of times that the inductor current IL reaches a predetermined maximum current to determined whether the auxiliary coil is short-circuited according to the count result. In this case, the predetermined maximum current is set in the design.

Hereinafter, the power factor correction controller 100 according to the exemplary embodiment of the present invention will be described in further detail with reference to FIG. 3.

Figure 3:
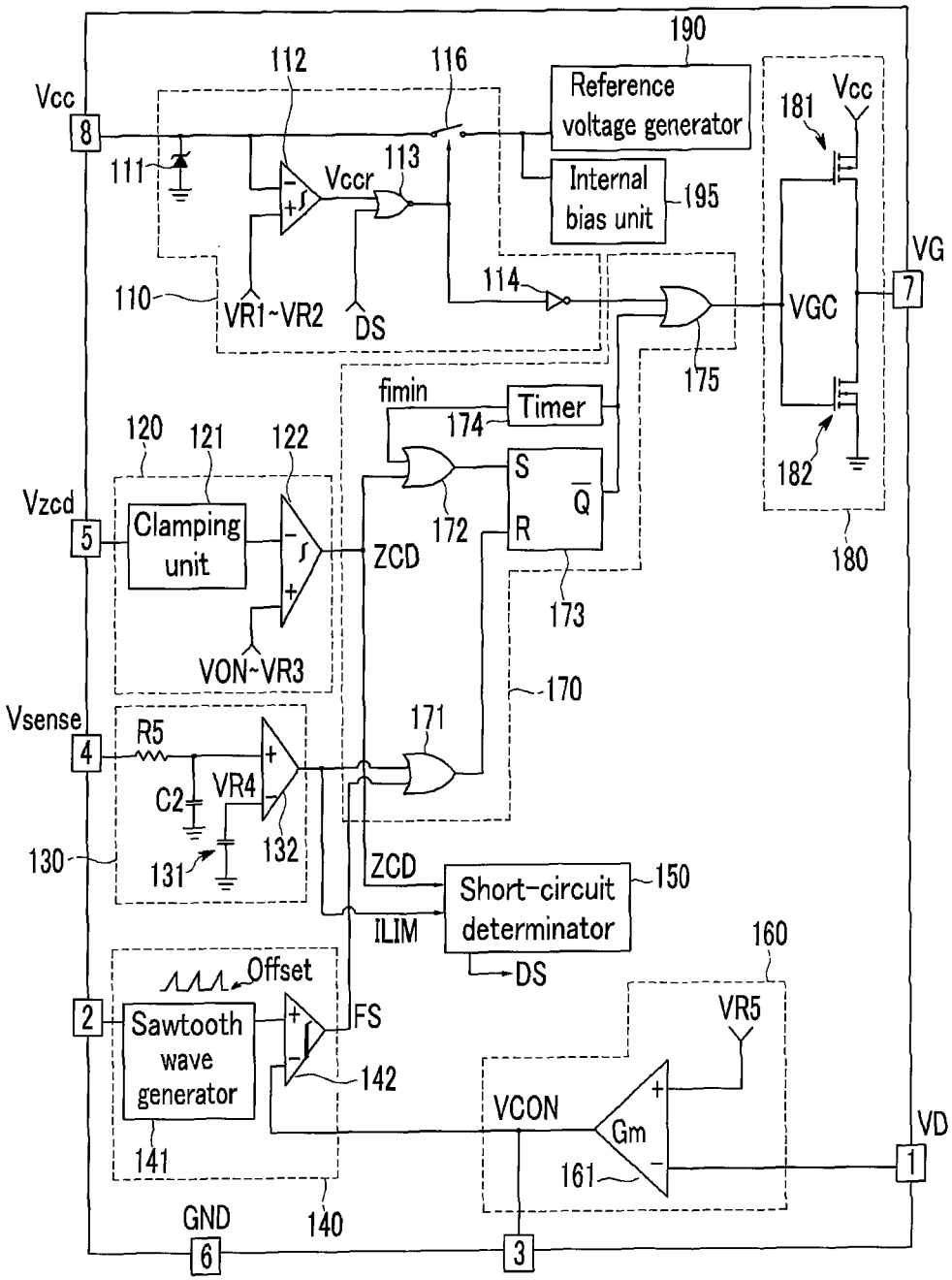
FIG. 3 shows a power factor correction controller according to the exemplary embodiment of the present invention.

FIG. 3 shows the power factor correction controller 100 according to the exemplary embodiment of the present invention.

The power factor correction controller 100 includes an under-voltage lockout (hereinafter, referred to as a UVLO 110, a zero current detecting unit 120, a maximum current sensor 130, a duty determining unit 140, a short circuit determinator 150, an error signal generator 160, a PWM controller 170, a gate driver 180, a reference voltage generator 190, and an internal bias unit 195.

The UVLO 110 controls the power switch M to stop the switching operation in order to prevent malfunction of the power factor correction controller 100 when the power source voltage Vcc is lower than a predetermined reference level.

The UVLO 110 compares the voltage Vcc input through the connection terminal 8 with a predetermined reference voltage, and stops the switching operation of the power switch M when the power source voltage Vcc is lower than the reference voltage. In this case, the reference voltage is a value set for stable operation of the power factor correction controller 100. This is so the malfunction of the power factor correction controller 100 can be prevented in advance.

The UVLO 110 includes a Zener diode 111, a hysteresis comparator 112, a NOR gate 113, an inverter 114, and a disconnection switch 116. An anode of the Zener diode 111 is grounded and a cathode thereof is connected to the connection terminal 8. When the power source voltage Vcc is higher than a breakdown voltage of the Zener diode 111, the Zener diode 111 is turned on and clamps the power source voltage Vcc to the breakdown voltage. Then, damage to the power factor correction controller 100 due to an overvoltage of the power source voltage Vcc can be prevented.

The hysteresis comparator 112 compares the power source voltage Vcc with a reference voltage VR1 and a reference voltage VR2 to generate a reset signal VCCR according to the comparison result. For stable operation of the power factor correction controller 100, the reference voltage is set to have a range between a first reference voltage VR1 and a second reference voltage VR2. The hysteresis comparator 112 outputs a high-level reset signal Vccr when the power source voltage Vcc is lower than the first reference voltage VR1, and outputs a low-level reset signal Vccr when the power source voltage Vcc is higher than the second reference voltage VR2. Due to the characteristic of the hysteresis, the second reference voltage is higher than the first reference voltage. That is, when the power source voltage Vcc is lower than the first reference voltage VR1, the hysteresis comparator 112 determines that the power source voltage Vcc is lower than a low voltage and thus turns off the power switch M, and turns off the disconnection switch 116 to prevent the power source voltage Vcc from being input to the power factor correction controller 100.

The disconnection switch 116 is turned on/off according to an output of the NOR gate 113. When the output of the NOR gate 113 is low level, the disconnection switch 116 is turned off, and when the output of the NOR gate 113 is high level, the disconnection switch 116 is turned on. When the power source voltage Vcc is lower than the first reference voltage VR1, the hysteresis comparator 112 outputs a high-level reset signal Vccr and the NOR gate 113 transmits a low-level output signal to the disconnection switch 116 without regard to a level of the disable signal DS. Then, the disconnection switch 116 is turned off and transmission of the power source voltage Vcc is blocked. The inverter 114 inverts the output of the NOR gate 113 and transmits the inverted output to the PWM controller 170. When an OR gate 175 of the PWM controller 170 outputs a high-level output, a NMOSFET 182 of the gate driver 180 is turned on and thus the power switch M is turned off. The inverter 114 inverts the low-level output signal of the NOR gate 113 and transmits a high-level signal to the OR gate 175, and therefore the power switch M is turned off when a high-level reset signal Vccr is generated.

The zero current detecting unit 120 detects a point when the current flowing to the inductor L1 becomes zero according to the zero current detection voltage Vzcd to determine a turn-on time of the power switch M. The zero current detecting unit 120 determines that the current does not flow to the inductor L1 at the time when the zero current detection voltage Vzcd reaches to the zero current reference voltage, and generates a zero current detection signal ZCD for turning on the power switch M. The auxiliary voltage Vaux is changed depending on a connection state of the power switch M, the input voltage Vin, the output voltage Vout, and the turn ratio. That is, the zero current detection signal ZCD is generated by being synchronized at the time the inductor current becomes zero.

Figure 4A:
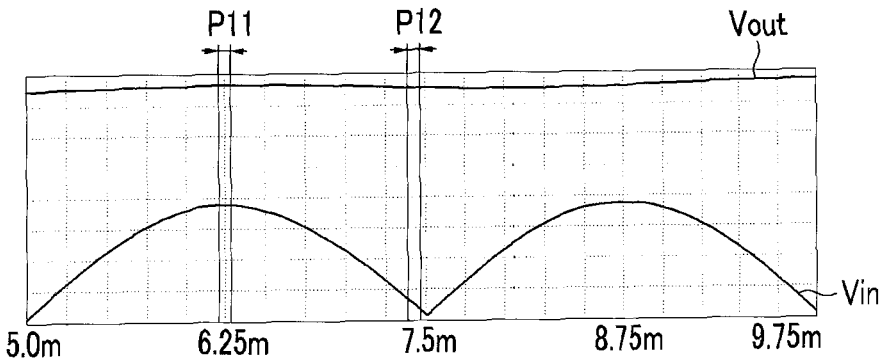
FIG. 4A shows waveforms of input and output voltages.

FIG. 4A shows waveforms of the input and output voltages Vin and Vout.

Figure 4B:
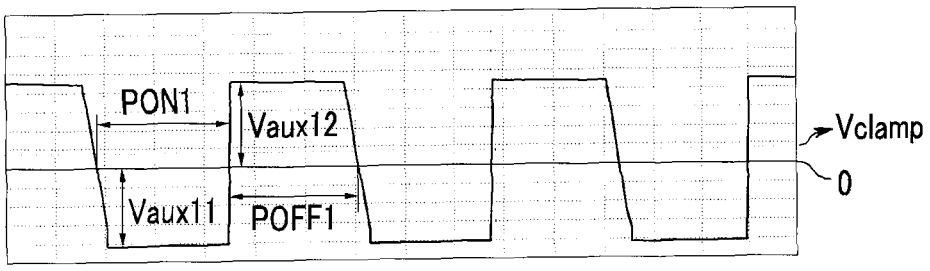
FIG. 4B shows a waveform of an auxiliary voltage for a first period P11 that includes a peak point of the input voltage.
Figure 4C:
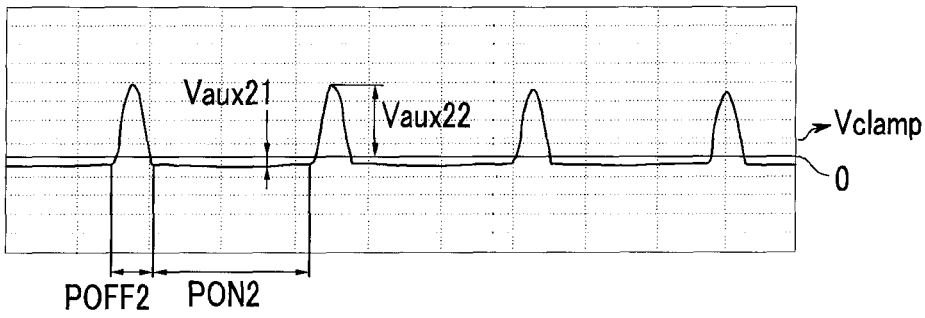
FIG. 4C shows a waveform of an auxiliary voltage for a second period P12 during which the input voltage is close to a ground voltage.

FIG. 4B shows a waveform of the auxiliary voltage Vaux for a first period P11 during which the input voltage Vin is at the peak point. FIG. 4C shows a waveform of the auxiliary voltage Vaux for a second period P12 during which the input voltage Vin is close to the ground voltage.

The auxiliary voltage Vaux can be given as shown in Equation 1 and Equation 2 by using the input voltage Vin, the output voltage Vout, and the turn ratio (Naux/Nin) between the inductor L1 and the auxiliary coil L2. Equation 1 shows an auxiliary voltage when the power switch M is in the turn-off state, and Equation 2 shows an auxiliary voltage when the power switch M is in the turn-on state.

$$Vaux=(Naux/Nin)(Vout-Vin) \quad \text{(Equation 1)}$$

$$Vaux=-(Naux/Nin)Vin \quad \text{(Equation 2)}$$

As shown in FIG. 4B and FIG. 4C, the auxiliary voltage Vaux is a negative voltage during turn-on periods PON1 and PON2 of the power switch M, and the auxiliary voltage is a positive voltage during turn-off periods POFF1 and POFF2 of the power switch M1. When the power switch M is in the turn-on state, the absolute value of the auxiliary voltage Vaux is increased as the input voltage Vin is increased.

The power factor correction controller 100 receives the zero current detection voltage Vzcd through the connection terminal 5. It is not preferable to input a negative voltage to an IC in which the power factor correction controller 100 is substantially realized. The negative voltage generally generates stress in the IC. In order to prevent this, the zero current detection voltage Vzcd is increased to a negative clamping voltage VCN, which is a predetermined positive voltage, when the auxiliary voltage Vaux is a negative voltage in the exemplary embodiment of the present invention. Therefore, the lowest value of the zero current detection voltage Vzcd is substantially the negative clamping voltage Vclamp. In the exemplary embodiment of the present invention, a current is supplied to the resistor R4 in order to increase the zero current detection voltage Vzcd to the negative clamping voltage Vclamp.

The power factor correction circuit according to the exemplary embodiment of the present invention is a boundary conductive mode according to the exemplary embodiment of the present invention. Thus, when the power switch M is turned off and the inductor current IL is zero, a resonance is generated between the inductor L1 and a parasitic capacitor (not shown) of the power switch M. Then, the voltage of the inductor L1 is decreased in a sine wave form, the auxiliary voltage Vaux is decreased, and the zero current detection voltage Vzcd is decreased. Once the zero current detection voltage Vzcd starts to decrease, the power factor correction controller 100 detects that the inductor current IL is zero and turns off the power switch M after a predetermined delay. In further detail, when the zero current detection voltage Vzcd is decreased to a predetermined on-reference voltage, the power factor correction controller 100 turns on the power switch M.

In further detail, the zero current detecting unit 120 includes a clamping unit 121 and a hysteresis comparator 122.

The clamping unit 121 fixes a voltage range of the zero current detection voltage Vzcd to a predetermined clamping range. In this case, the lowest value of the clamping range is the minimum clamping voltage Vclamp.

The hysteresis comparator 122 compares the zero current detection voltage Vzcd with an ON reference voltage VON in order to sense a point that the inductor current IL becomes zero, and generates a zero current detection signal ZCD for turning on the power switch M according to the comparison result. That is, the power factor correction controller 100 according to the exemplary embodiment of the present invention regards a point that the zero current detection voltage Vzcd is decreased to the ON reference voltage VON as the point that the inductor current becomes zero. The hysteresis comparator 122 generates a high-level zero current detection signal ZCD by being synchronized at the point that the zero current detection voltage Vzcd is decreased to the ON reference voltage VON, and generates a low-level zero current detection signal ZCD by being synchronized at a point that the zero current detection voltage Vzcd is increased to a third reference voltage VR3 that is higher than the ON reference voltage according to the hysteresis characteristic.

Therefore, when the zero current detection voltage Vzcd is decreased to the ON reference voltage VON after the power switch M is turned off, the hysteresis comparator 122 outputs a high-level zero current detection signal ZCD. When the power switch M is synchronized with the high-level zero current detection signal ZCD and is thus turned on, the zero current detection voltage Vzcd is decreased to a negative voltage according to a multiple of the input voltage and the turn ratio.

Since the zero current detection voltage Vzcd becomes lower than the minimum clamping voltage Vclamp, the clamping unit 121 increases the zero current detection voltage Vzcd to the minimum clamping voltage for clamping. In the exemplary embodiment of the present invention, when the minimum clamping voltage Vclamp is set to be lower than the third reference voltage VR3 and the zero current detection voltage Vzcd is clamped, the hysteresis comparator 122 outputs the high-level zero current detection signal ZCD. Since an S/R latch 173 reacts only to a rising edge of a signal input to a set terminal S and a reset terminal R, the hysteresis comparator 122 outputs a high-level signal through an inversion output terminal (/Q) when the rising edge is input to the reset terminal R even through the zero current detection signal ZCD is maintained at high level.

As described, the zero current detection signal ZCD according to the exemplary embodiment of the present invention is a pulse signal that is synchronized at the point that the inductor current becomes zero and thus the rising edge is generated and is maintained at the high level during the turn-on period of the power switch M.

The maximum current sensor 130 compares the sense voltage Vsense with a predetermined reference voltage, and generates a maximum current sense signal ILIM when the inductor current IL reaches the maximum current according to the comparison result. Then, the power switch M is turned off by the maximum current sense signal ILIM. When the power switch M is turned on, the inductor current IL and the switch current Ids of the power switch M are equal to each other so that whether the inductor current IL reaches the maximum current can be determined by using the switch current Ids of the power switch M. That is, as previously described, when the sense voltage Vsense reaches the reference voltage VR4, the inductor current IL is determined to have reached the maximum current. The maximum current sensor 130 includes a resistor R5, a capacitor C2, a reference voltage source 131, and a comparator 132. The comparator 132 compares a reference voltage VR4 that is supplied to an inversion (−) terminal by the reference voltage source 131 with the sense voltage Vsense input to a non-inversion (+) terminal, and transmits a high-level signal to the OR gate 171 of the PWM controller 170 when the sense voltage Vsense is higher than the reference voltage VR4. Then, the OR gate 171 outputs the high-level signal to the reset terminal of the SR latch 173 and the SR latch 173 outputs the high-level signal to the OR gate 175. Then, the gate driver 180 outputs a low-level gate signal VG to turn off the power switch M.

The error amplification signal generator 160 compares the division voltage VD corresponding to the output voltage Vout with a predetermined reference voltage VR to generate an error amplification signal VCON. The error amplification signal generator 160 includes an error amplifier 161, and a voltage gain of the error amplification signal VCON is adjusted for each frequency component by the capacitor C1. The error amplifier 161 includes a non-inversion (+) terminal to which the reference voltage VR5 is input and an inversion (−) terminal to which the division voltage VD is input, and amplifies a difference between the lateral voltages by a predetermined gain Gm to generate the error amplification signal VCON.

The duty determining unit 140 determines a turn-off time of the power switch M using the sawtooth wave signal SW and the error amplification signal VCON. The duty determining unit 140 includes a sawtooth wave generator 141 and a comparator 142.

The sawtooth wave generator 141 generates a sawtooth wave signal by flowing a current that is proportional to a current flowing to the resistor R3 into an internal capacitor (not shown) during the turn-on period of the power switch M. In further detail, the power factor correction controller 100 includes a constant voltage (not shown), and a constant voltage source is connected to the resistor R3 such that a predetermined current flows to the resistor R3. The sawtooth wave generator 141 current mirrors the current flowing to the resistor R3 to generate the sawtooth wave.

The sawtooth wave signal SW is a voltage signal that increases with a constant slope for a turn-on period of the power switch M during one period with reference to a predetermined offset voltage. The comparator 142 includes an inversion (−) terminal to which the error amplification signal VCON is input and a non-inversion (+) terminal to which the sawtooth wave signal SW is input, and outputs a high-level OFF control signal FS when a signal input to the non-inversion (+) signal reaches the level of a signal input to the inversion (−) terminal.

The short circuit determinator 150 continuously counts the number of times that the inductor current IL reaches the maximum current, and stops the switching operation of the power switch M when the count result reaches a predetermined short circuit threshold count. When the auxiliary coil L2 is short-circuited, the inductor current IL first reaches the maximum current. However, as previously described, the inductor current IL can reach the maximum current by a wave-rectified input voltage, and can reach the maximum current during a start-up period.

The short circuit threshold count according to the exemplary embodiment of the present invention is set in consideration thereof. For example, the short circuit threshold count is set to be larger than the number of generation times of the maximum current for a high input voltage period and the number of generation times of the maximum current for the start-up period. In addition, the switch current Ids of the power switch M corresponding to the inductor current IL and the maximum current are compared, and the comparison result is counted. When the power switch M is in the turn-on state, the switch current Ids is the same as the inductor current IL. The short circuit determinator 150 will be described later in further detail with reference to FIG. 5 and FIG. 6A to FIG. 6C.

The PWM controller 170 includes OR gates 171, 172, and 175, an SR latch 173, and a timer 174. The PWM controller 170 receives output signals from the UVLO 110, the zero current detecting unit 120, the maximum current sensor 130, and the duty determining unit 140, and generates a gate driver control signal VGC for switching operation control of the power switch M and outputs the generated signal.

When the power switch M is not turned on during the maximum set period, the timer 174 turns on the power switch M by force to control the switching operation of the power switch M with the minimum switching frequency. That is, the timer 174 generates a high-level ON time pulse signal fmin to turn on the power switch M, and outputs the signal to the OR gate 172 when a high-level output signal of the SR latch 173 is sensed during a predetermined maximum set period. Then, a rising edge of the output signal of the OR gate 172 is input to a set terminal S of the SR latch 173 so that a low-level signal is output to an inversion output terminal /Q.

The OR gate 171 receives the maximum current detection signal ILIM and the OFF control signal FS, and outputs a high-level signal when at least one of the two received signals is high level. Then, the rising edge of the output signal of the OR gate 171 is input to a reset terminal R of the SR latch 173, and the SR latch 173 outputs a high-level signal to the OR gate 175 through the inversion output terminal /Q.

The OR gate 172 receives the ON time pulse signal fmin and the zero current detection signal ZCD, and outputs a high-level signal when at least one of the two received signals is high level. Then, a rising edge of an output signal of the OR gate 172 is input to the set terminal S of the SR latch 173, and the SR latch 173 outputs a low-level signal to the OR gate 175 through the inversion output terminal /Q.

The SR latch 173 outputs a low-level signal to the inversion output terminal /Q when the rising edge is input to the set terminal S, and when the rising edge is input to the reset terminal S, the SR latch 173 outputs a high-level signal to the inversion output terminal /Q. The SR latch 173 maintains a current output state when no rising edge is input to the set terminal S and the reset terminal R.

The OR gate 175 receives the output signal of the UVLO 110 and the output signal of the SR latch 173 and generates the gate driver control signal VGC. The OR gate 175 outputs a high-level gate driver control signal VGC when at least one of the received signals is high level, and outputs a low-level gate driver control signal VGC when all the input signals are low level.

The gate driver 180 includes a PMOSFET 181 and a NMOSFET 182, and outputs a high-level voltage Vcc or a low-level (i.e., ground voltage) gate signal VG according to the gate driver control signal VGC. The voltage Vcc is input to a source electrode of the PMOSFET 181, and a drain electrode of the PMOSFET 181 is connected to a drain electrode of the NMOSFET 182. A source electrode of the NMOSFET 182 is grounded, and the gate driver control signal VGC is input to the gate electrodes of the PMOSFET 181 and NMOSFET 182. Therefore, when a low-level gate driver control signal VGC is input to the gate driver 180, the gate driver 180 outputs a high-level gate signal VG, and when a high-level gate driver control signal VGC is input to the gate driver 180, the gate driver 180 outputs a gate signal VG of a ground voltage.

Hereinafter, a configuration of the short circuit determinator 150 and operation thereof will be described in further detail with reference to FIG. 5 and FIG. 6A to FIG. 6C.

Figure 5:
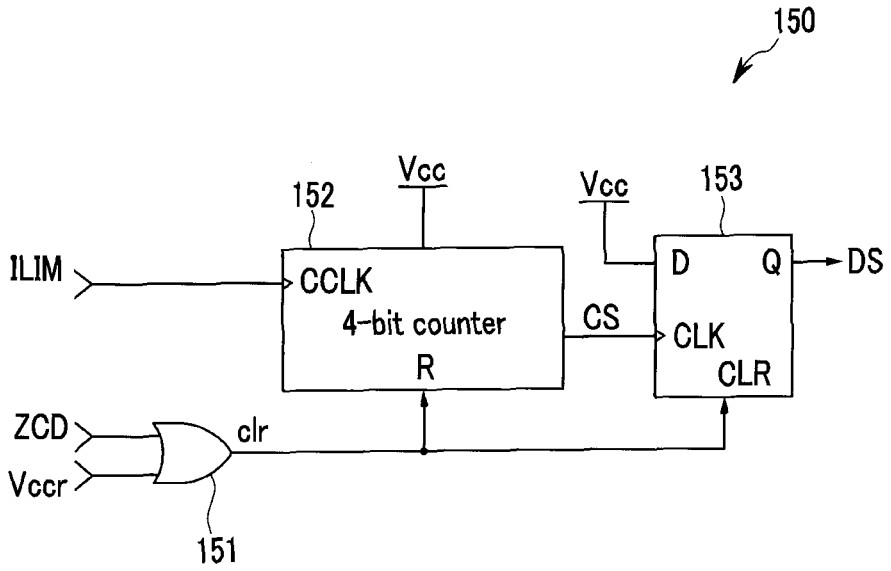
FIG. 5 shows a short circuit determinator according to the exemplary embodiment of the present invention.

FIG. 5 shows the short circuit determinator 150 according to the exemplary embodiment of the present invention.

The short circuit determinator 150 includes an OR gate 151, a 4-bit counter 152, and a D-flipflop 153. The short circuit determinator 150 according to the exemplary embodiment of the present invention includes the 4-bit counter 152, but the present invention is not limited thereto. That is, the short circuit determinator 150 may include an N-bit counter according to a short circuit threshold count (here, N is a natural number). In the exemplary embodiment of the present invention, the short-circuit threshold count is set to $16=2^4$, and accordingly a 4-bit counter is used. That is, when a number of times that the inductor current IL reaches the maximum current becomes 16, the auxiliary coil L2 is determined to be short-circuited.

The OR gate 151 receives the zero current detection signal ZCD and the reset signal Vccr, and generates a clear signal clr. The OR gate 152 generates a high-level clear signal clr when at least one of the two received signals is high level. A reset terminal R of the 4-bit counter 152 and the D-flipflop 153 reset a current output state according to a high-level clear signal clr input to a clear terminal CLR.

The 4-bit counter 152 counts a ringing point of a signal input to the clock terminal CCLK, and generates a count signal CS when the count result reaches the short circuit threshold count. The clear signal clr is input to a reset terminal R of the 4-bit counter 152, and the 4-bit counter 152 is synchronized with a high-level clear signal clr to reset the count result to zero. The 4-bit counter 152 generates the high-level count signal CS when the count result reaches the short circuit threshold count, and resets the count signal CS to low level according to the clear signal clr. The 4-bit counter 152 is biased by the power source voltage Vcc.

The D-flipflop 153 is biased by a voltage Vcc input to an input terminal D, and generates a disable signal DS by being synchronized with the count signal CS input to the clock terminal CLK. In further detail, when the count signal CS is high level, the D-flipflop 153 generates a high-level disable signal DS by being synchronized with a rising point of the count signal CS.

Figure 6A:
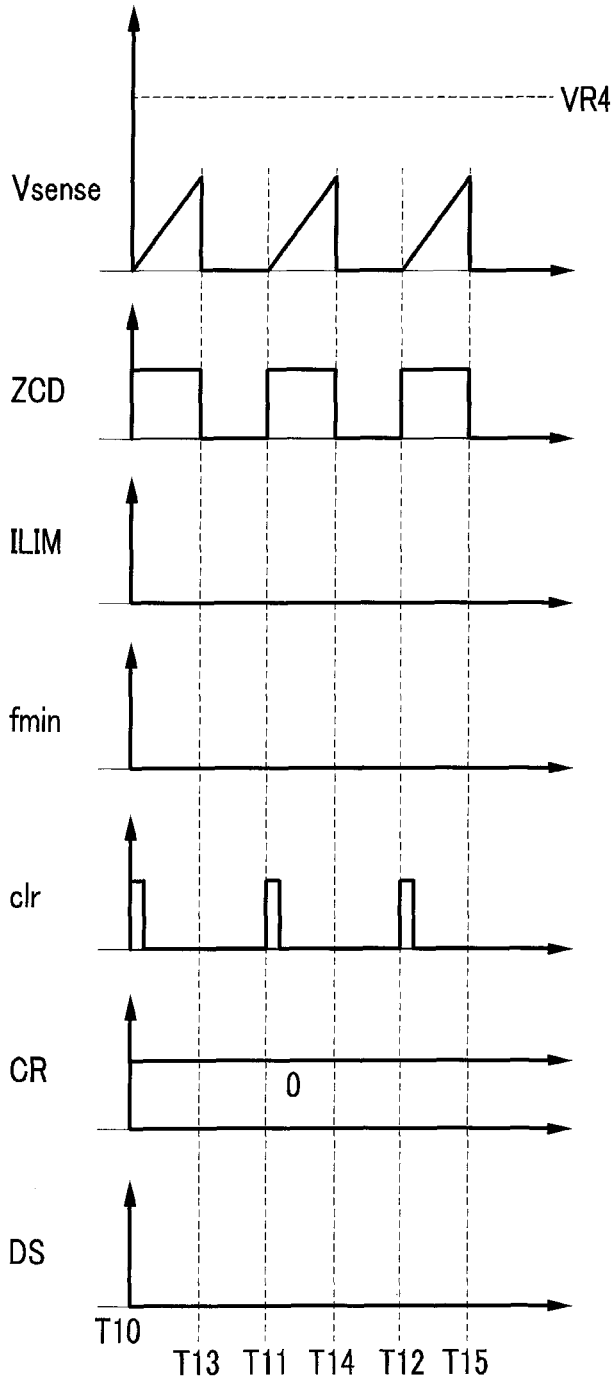
FIG. 6A shows a sense voltage, a zero-crossing detection signal, a maximum current sense signal, an ON-pulse signal, a clear signal, a counter result, and a disable signal in the case that the power factor correction circuit operates in a normal condition.
Figure 6B:
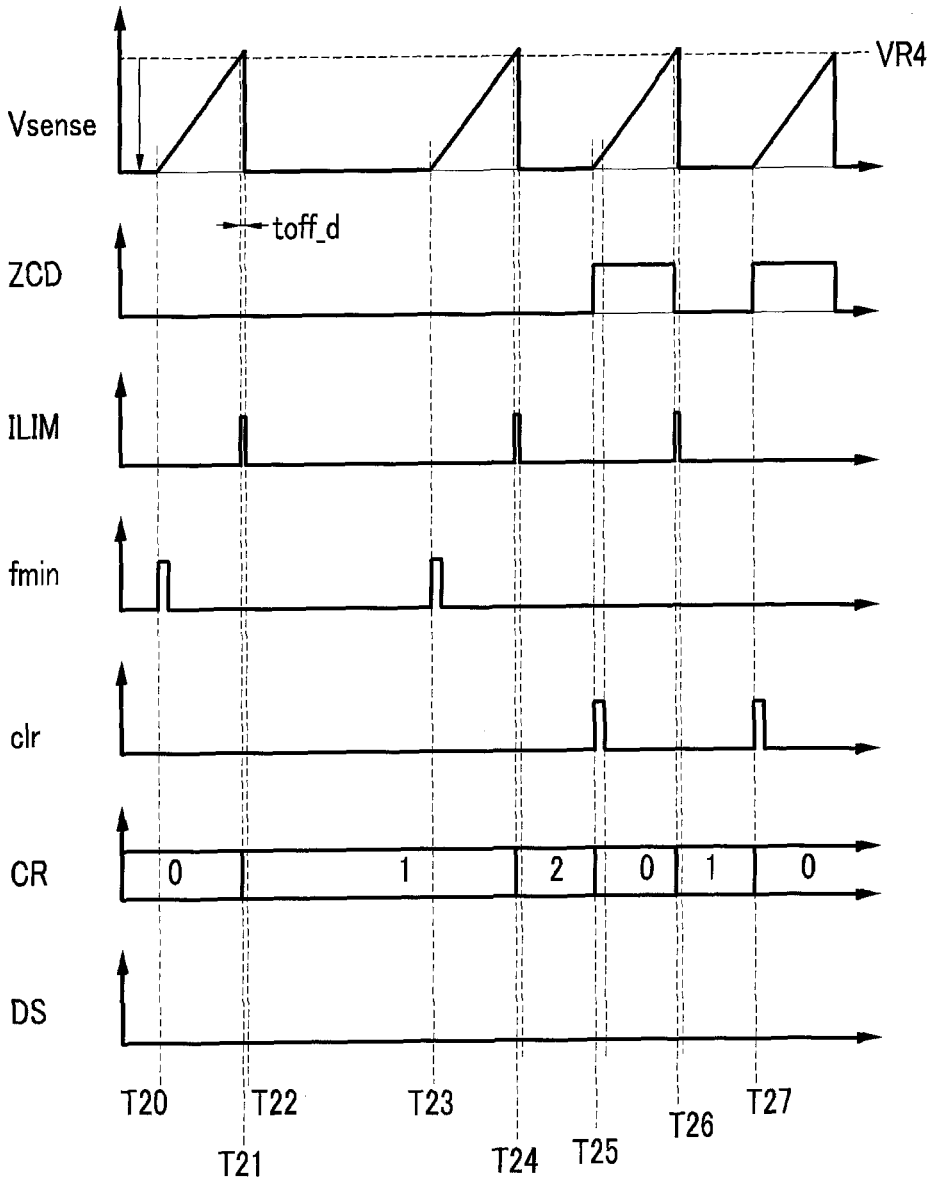
FIG. 6B shows a sense voltage, a zero-crossing detection signal, a maximum current sense signal, an ON-pulse signal, a clear signal, a counter result, and a disable signal in the case that the power factor correction circuit operates in a start-up condition.
Figure 6C:
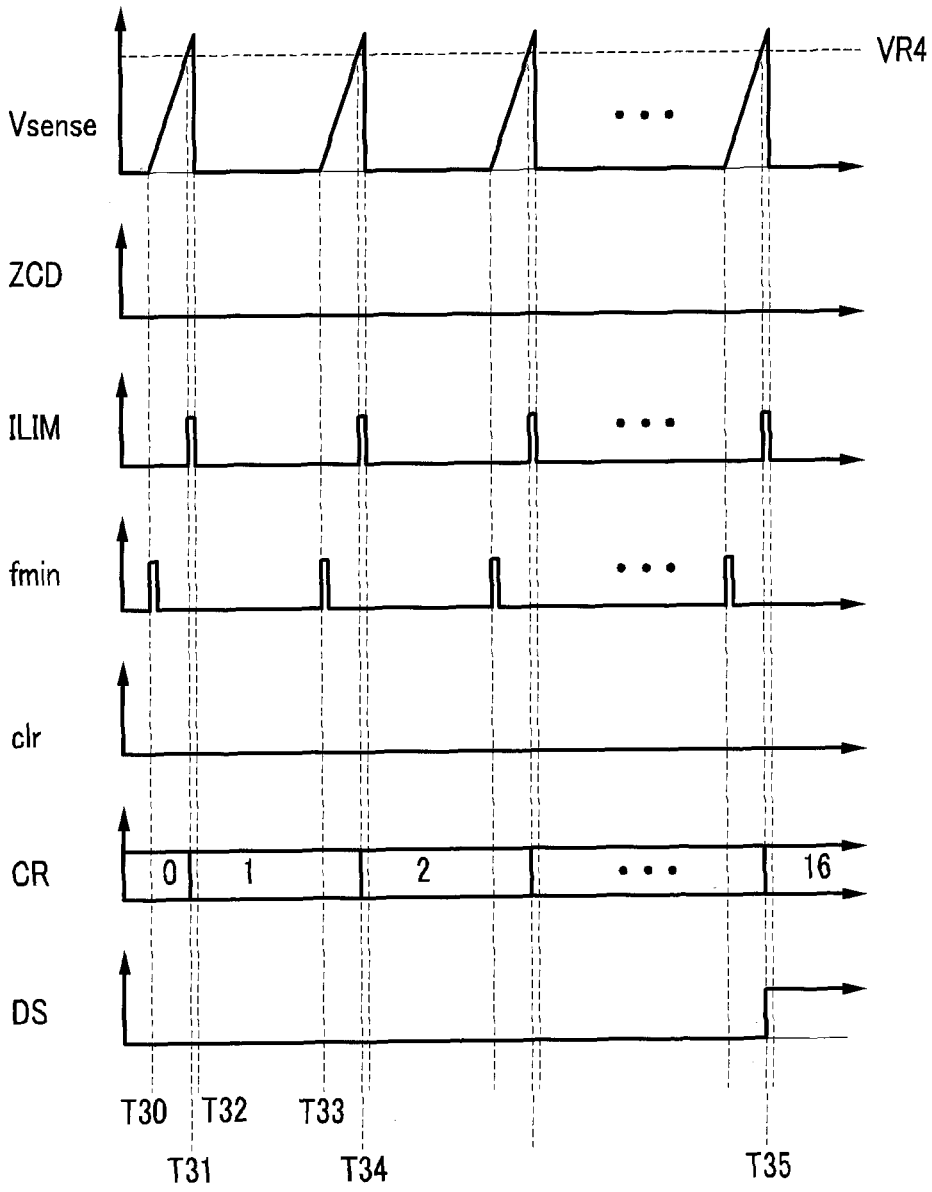
FIG. 6C shows a sense voltage, a zero-crossing detection signal, a maximum current sense signal, an ON-pulse signal, a clear signal, a counter result, and a disable signal in the case that an auxiliary wire of the power factor correction circuit is short-circuited.

FIG. 6A to 6C are waveform diagrams illustrating signals input to and output from the short circuit determinator for description of operation of the short circuit determinator according to the exemplary embodiment of the present invention depending on the condition of the power factor correction circuit.

FIG. 6A shows a sense voltage, a zero crossing detection signal, a maximum current sense signal, an ON pulse signal, a clear signal, a count result CR, and a disable signal in the case that the power factor correction circuit operates in a normal condition.

As shown in FIG. 6A, the zero current detection signal ZCD becomes a high-level pulse at time points T10, T12, and T12 in a normal condition. When synchronized at the rising time points T10, T11, and T12, the power switch M is turned on, the switch current starts to increase, and the sense voltage starts to increase. Since the power switch M is turned on by the zero crossing detection signal, an ON pulse signal fmin is not generated and the clear signal clr becomes a short-pulse signal generated according to a rising edge of the zero current detection signal ZCD. In a normal condition, the power switch M is turned off at time points T13, T14, and T15 when a sawtooth wave signal SAW reaches the error amplification signal VCON so that the switch current Ids does not flow and the sense voltage becomes zero. Since the switch current Ids does not reach the maximum current in the normal condition, the maximum current detection signal ILIM is not generated. That is, the sense voltage VSENSE does not reach the reference voltage VR4 in the normal condition, and therefore the maximum current detection signal is not generated.

FIG. 6B shows a sense voltage, a zero crossing detection signal, a maximum current sense signal, an ON pulse signal, a clear signal, a count result, and a disable signal when the power factor correction circuit operates in a start-up state.

The start-up state implies that the power factor correction circuit starts operation and thus an output voltage of the power factor correction circuit is increased to an output voltage of the normal condition. During this period, the output voltage level is low because it is increasing so that the error amplification signal VCON is very large. Thus, the sawtooth wave signal SAW cannot reach the error amplification signal VCON, and when the switch current Ids reaches the maximum current, the power switch M is turned off. That is, the power switch M is turned off at the time point that the sense voltage reaches the reference voltage VR4.

At a time point T20, the power switch M is turned on by the ON pulse signal, the switch current starts to flow, and the sense voltage starts to increase.

At a time point T21, when the sense voltage reaches the reference voltage, the maximum current sense voltage becomes a high level pulse. Then, the count result becomes 1. A period tff_d from the time point T21 that the maximum current sense signal becomes the high level pulse to a time point T22 that the power switch M is turned off by the maximum sense signal is a predetermined delay period generated by transmission delay. During this delay period, the maximum current sense signal becomes a high level pulse.

The power switch M is turned on by the ON pulse signal at a time point T23 and the sense voltage reaches the reference voltage at a time point T24 such that the count result becomes 2.

When the start-up state is finished and thus the inductor current IL becomes zero, the zero current detection signal zcd becomes high level at a time point T25. Then, the clear signal clr becomes high level, and the count result resets to zero.

Although the start-up state is finished, the switch current may be higher than the maximum current by an input voltage. When the sense voltage reaches the reference voltage at a time point T26, the maximum current sense signal becomes high level and the count result becomes 1.

However, since a time point that the inductor current IL becomes zero occurs, the zero current detection signal zcd becomes high level at a time point T27, the clear signal becomes high level, and the count result resets to zero.

A case when the auxiliary coil is short-circuited will be described with reference FIG. 6C.

FIG. 6C shows a sense voltage, a zero crossing detection signal, a maximum current sense signal, an ON pulse signal, a clear signal, a count result, and a disable signal in the case that the auxiliary coil of the power factor correction circuit is short-circuited.

At a time point T30, the power switch M is turned on by the ON pulse signal, the switch current starts to flow, and the sense voltage starts to increase.

At a time point T31, when the reference voltage reaches the sense voltage, the maximum current sense signal becomes a high level pulse. Then, the count result becomes 1. A period toff_d from a time point that the maximum current sense signal becomes the high level pulse to a time point T32 that the power switch M is turned off is the delay period.

At a time point T33, the power switch M is turned on by the ON pulse signal, and the reference voltage reaches the sense voltage at a time point T34 and the count result becomes 2.

In the short circuit state of the auxiliary coil L2, the zero current detection signal zcd that indicates the inductor current IL is zero is not generated. Thus, the clear signal clr is not generated. At a time point T35 when the 16th high-level pulse of the maximum current sense signal ILIM is generated, the counter signal CS becomes high level, and the D-flipflop is synchronized at a rising time point of the counter signal CS to generate a high-level disable signal DS.

Then, the power switch M is turned off.

As described, a power factor correction apparatus according to the exemplary embodiment of the present invention can precisely and effectively sense a short circuit of the auxiliary coil.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS line filter 10, bridge diode 20, inductor L1, power switch M
capacitor Cout, C1, 11, and 12, sense resistor RS, auxiliary coil L2
diodes D 21 to 24, output voltage division resistors R1 and R2, power factor correction controller 100
inductors 13, 14, and 114, under-voltage lockout 110, zero current detecting unit 120
maximum current sensor 130, duty determining unit 140, short circuit determinator 150
error signal generator 160, PWM controller 170, gate driver 180
reference voltage generator 190, internal bias unit 195, Zener diode 111
hysteresis comparator 112 and 122, NOR gate 113, inverter 114
disconnection switch 116, clamping unit 121, reference voltage source 123, sawtooth wave generator 141
comparator 142, OR gates 171, 172, and 175, SR latch 173, timer 174
OR gate 151, 4-bit counter 152, D-flipflop 153

What is claimed is:

1. A power factor correction circuit comprising:
an inductor receiving an input voltage and supplying output power;
a power switch connected to the inductor and controlling an inductor current flowing in the inductor;
an auxiliary coil coupled with the inductor with a predetermined turn ratio; and
a power factor correction controller controlling the output power by controlling a switching operation of the power switch and counting the number of times that the inductor current reaches a predetermined maximum current to turn off the power switch when the count reaches a predetermined short circuit threshold count.

2. The power factor correction circuit of claim 1, wherein the power factor correction controller counts the number of times that a switch current flowing in the power switch, corresponding to the inductor current, reaches the maximum current and turns off the power switch when the count results in the short circuit threshold count.

3. The power factor correction circuit of claim 2, wherein the power factor correction controller resets the count result when the inductor current becomes zero.

4. The power factor correction circuit of claim 3, wherein the power factor correction controller comprises:
an N-bit counter counting the number of times that the switch current reaches the maximum current (here, N is a natural number);
a D-flipflop generating a disable signal according to an output of the N-bit counter; and
a logic operator synchronized with a time point when the inductor current becomes zero and resetting the N-bit counter and the D-flip-flop,
wherein the N-bit has a value corresponding to the short circuit threshold count.

5. The power factor correction circuit of claim 4, wherein the power factor correction controller further comprises a comparator that compares a sense voltage corresponding to the switch current with a reference voltage corresponding to the maximum current to generate a maximum current sense signal when the sense voltage reaches the reference voltage.

6. The power factor correction circuit of claim 5, wherein the N-bit counter counts the number of times that the maximum current sense signal is generated and generates a count signal when the count result reaches the short circuit threshold count, and the D-flipflop generates the disable signal when the count signal is input.

7. The power factor correction circuit of claim 3, wherein the power factor correction controller receives a zero current detection voltage corresponding to a voltage of the auxiliary voltage, determines that the inductor current is zero when the zero current detection voltage is decreased to a predetermined ON reference voltage, and generates a zero current detection signal.

8. The power factor correction circuit of claim 7, wherein the power factor correction controller comprises:

an N-bit counter counting the number of times that the switch current reaches the maximum current (here, N is a natural number);

a D-flipflop generating a disable signal according to an output of the N-bit counter; and a logical operator resetting the N-bit counter and the D-flipflop according to the zero current detection signal, wherein the N-bit has a value corresponding to the short circuit threshold count.

9. The power factor correction circuit of claim 8, wherein the power factor correction controller comprises a comparator that compares a sense voltage corresponding to the switch current with a reference voltage corresponding to the maximum current to generate a maximum current sense signal when the sense voltage reaches the reference voltage.

10. The power factor correction circuit of claim 9, wherein the N-bit counter counts the number of generation times of the maximum current sense signal and generates a count signal when the count result reaches the short circuit threshold count, and the D-flipflop generates the disable signal when the count signal is input.

11. A driving method of a power factor correction circuit including an inductor receiving an input voltage and supplying output power, a power switch connected to the inductor to control an inductor current flowing in the inductor, and an auxiliary coil coupled with the inductor with a predetermined turn ratio, comprising:

counting the number of times that the inductor current reaches a predetermined maximum current; and turning off the power switch when the count result reaches a predetermined short circuit threshold count.

12. The driving method of claim 11, further comprising:

determining whether the inductor current is zero; and resetting the count result when the inductor current is zero.

13. The driving method of claim 12, wherein the determining whether the inductor current is zero comprises receiving a zero current detection voltage corresponding to a voltage of the auxiliary coil and determining that the inductor current is zero when the zero current detection voltage is decreased to a predetermined ON reference voltage.

14. The driving method of claim 11, wherein the counting the number of times that the inductor current reaches a predetermined maximum current comprises counting the number of times that a switch current flowing to the power switch, corresponding to the inductor current, reaches the maximum current.

15. The driving method of claim 14, wherein the counting the number of times that the switch current reaches the maximum current comprises:

comparing a sense voltage corresponding to the switch current with a reference voltage corresponding to the maximum current to generate a maximum current sense signal when the sense voltage reaches the reference voltage; and counting the number of generation times of the maximum current sense signal.

* * * * *